US007507114B2

(12) United States Patent
Kent et al.

(10) Patent No.: US 7,507,114 B2
(45) Date of Patent: Mar. 24, 2009

(54) MALE MEDICAL DEVICE ELECTRICAL CONNECTOR WITH ENGINEERED FRICTION FIT

(75) Inventors: Harold B. Kent, Portola Valley, CA (US); James J. Levante, Redwood City, CA (US); Thor Roff, Cupertino, CA (US); Joseph R. Layton, Sunnyvale, CA (US); Aaron T. Fine, San Jose, CA (US)

(73) Assignee: Medconx, Inc., Santa Clara, CA (US)

( * ) Notice: Subject to any disclaimer, the term of this patent is extended or adjusted under 35 U.S.C. 154(b) by 0 days.

(21) Appl. No.: 10/546,142

(22) PCT Filed: Feb. 18, 2004

(86) PCT No.: PCT/US2004/004814

§ 371 (c)(1),
(2), (4) Date: Dec. 14, 2006

(87) PCT Pub. No.: WO2004/075349

PCT Pub. Date: Sep. 2, 2004

(65) Prior Publication Data

US 2007/0149011 A1 Jun. 28, 2007

Related U.S. Application Data

(60) Provisional application No. 60/448,517, filed on Feb. 18, 2003.

(51) Int. Cl.
*H01R 13/52* (2006.01)

(52) U.S. Cl. ..... 439/518; 439/174; 439/272

(58) Field of Classification Search ..... 439/166, 439/171–177, 189, 518, 271–278, 283
See application file for complete search history.

(56) References Cited

U.S. PATENT DOCUMENTS

| | | | | |
|---|---|---|---|---|
| 4,609,247 | A * | 9/1986 | Annoot | 439/591 |
| 4,674,807 | A * | 6/1987 | Boteler et al. | 439/106 |
| 5,012,807 | A | 5/1991 | Stutz | |
| 5,199,893 | A * | 4/1993 | Fussell | 439/271 |
| 5,295,864 | A | 3/1994 | Birch et al. | |
| 5,324,207 | A * | 6/1994 | Itoh et al. | 439/125 |
| 6,475,008 | B1 * | 11/2002 | Marolda et al. | 439/271 |

FOREIGN PATENT DOCUMENTS

GB 2353643 2/2001

OTHER PUBLICATIONS

Supplemental European Search Report for corresponding EP Application (04712398), 3 pages, Dated Oct. 9, 2007.
International Search Report, PCT/US04/04814 (Oct. 5, 2004).

* cited by examiner

*Primary Examiner*—Ross N Gushi
(74) *Attorney, Agent, or Firm*—Jones Day

(57) ABSTRACT

A male connector includes a body and an elastomeric member. The body has a proximal end and a distal end. The elastomeric member is disposed around an outer surface of the distal end of the body. The distal end of the body is configured to be received into a female connector interface in a device. The proximal end of the body is configured to couple with an electronic block connector selected from a plurality of electronic block connectors, each of which has a different pin arrangement but a common coupling interface.

3 Claims, 8 Drawing Sheets

MALE MEDICAL DEVICE ELECTRICAL CONNECTOR WITH ENGINEERED FRICTION FIT

RELATED APPLICATION

This application claims the benefit of priority under U.S.C. § Section 119 to U.S. Provisional Patent Application 60/448,517, filed Feb. 18, 2003, entitled A Method for Fitting and Latching Circular Male Connectors Which Also Enables Creation of a Universal Connector system.

TECHNICAL FIELD

The present invention relates to electrical connectors for medical devices, but can be used for other connector applications.

BACKGROUND OF THE INVENTION

Most medical device systems involve proprietary electrical, fiber optic and mechanical interconnection systems that can only be interconnected to other proprietary interconnection systems. Moreover, most medical device electrical connectors are also typically proprietary systems. Such medical device electrical connectors are specifically designed and built for only one type of application. As a result, it is typically not possible to interconnect the components of medical devices made by different manufacturers. As a result, many medical devices can only be operated when connected to proprietary equipment. For example, many medical devices can only be operated with specific power supplies or generators sold by the same manufacturer. In addition, such medical devices may only be adapted to interconnect with proprietary fluid, gas, cryogen, fiber optic, high frequency RF, mechanical coupling, magnetic, capacitive, and vacuum systems.

A disadvantage of such proprietary electrical connector systems is that medical device operators are not able to "mix and match" various medical device equipment combinations together. For example, due to the electrical connector or other type of interconnection system itself being proprietary equipment, a particular medical device may only be configured for use with a particular generator.

What is instead desired is a flexible electrical connection system permitting various medical (or non-medical) device equipment to be interconnected together. This would give a user has greater freedom to interconnect different medical device components together as desired. The ability to instead individually select different medical device components and interconnect them together would instead provide versatility and cost savings to the user.

A second disadvantage of proprietary electrical connector systems is that they are inherently expensive. This is due to the fact that they are individually designed, and made in short production runs. Moreover, they tend to be mechanically intricate, typically involving many small levers, tabs and connecting elements. Thus, they may easily become damaged or broken.

What is instead desired is a flexible electrical connector system that can be produced at lower cost. Such a system would ideally be simple in design and easy to operate. In addition, it is desirable that such a system be engineered to have a preferred tactile feel which is tunable, i.e.: which can be engineered such that system exhibits a finely tuned preferred insertion strength when plugged into the female connector and a finely tuned preferred retention strength when unplugged from the female connector. As such, it is preferable that the connector be engineered with a preferred coefficient of friction, thus giving the connector a preferred engineered friction fit.

SUMMARY OF THE INVENTION

The present invention provides a male (or female, or hermaphroditic) electrical (or other) interconnection system connector for use with a medical (or non-medical) device. In preferred embodiments, the male connector has a body with proximal and distal ends, with an elastomeric member disposed at least partially around an outer (or inner) surface of the distal end. The distal end of the connector body is configured to be received into a female connector interface in a medical device, and the proximal end of the connector body is configured to receive an electronic block connector therein. It is to be understood that either end of either connector can have the smart block and/or pin set. Also, either side can mate and demate. Most preferably, the medical device is a medical generator. It is to be understood, however, that the present invention is not limited to uses solely with medical devices. Rather, all forms of electronic devices are contemplated, all keeping within the scope of the present invention. It is also to be understood that such electronic block connector may be substituted by pins, or by any other interconnection system, all keeping within the scope of the present invention.

In preferred embodiments, the elastomeric member is an O-ring. The elastomeric member O-ring may be made to have any of a number of different cross sections and shapes. The elastomeric member may optionally be made of various materials, including but not limited to, the following materials: (1) Nitrile (Buna-N, NBR), which has the advantage of being carbon triple-bonded to nitrogen which provides resistance to oils and fuels; (2) EP (EPR, EPDM, Ethylene Propylene) which has the advantage of offering outstanding resistance to polar solvents like acetone, alcohols, and MEK; (3) VitonR (Fluorocarbon) which has the advantage of excellent chemical resistance and an outstanding upper temperature limit; (4) Neoprene (Chloroprene) which has the advantage of offering significantly better oil resistance than natural rubber; (5) Fluorosilicone, which uses a silicon-oxygen (siloxane) main backbone for excellent thermal stability and highly fluorinated side chains for oil resistance; (6) Silicone, which uses a silicon-oxygen (siloxane) main backbone for excellent thermal stability; (7) KalrezR: a perfluoroelastomer, which has the advantage of high temperature stability, maintaining seal integrity; and (8) Cast Polyurethane.

In addition, the elastomeric member may be made from any of a variety of different materials, having different durometers, for use in particular interconnection connector designs.

The elastomeric member may optionally be received into a groove on the outer surface of the distal end of the body. Various elastomeric member thickness, groove construction, and groove depths are contemplated, all keeping within the scope of the present invention. The elastomeric member may also have a constant or variable cross sectional area. In various embodiments, a plurality of elastomeric members may be disposed on the outer surface of the distal end of the connector body. The male connector body may also optionally have a collar dimensioned to limit the depth to which the male connector is received into the female connector.

The electronic block connector received into the proximal end of the body may optionally include an electronic block connector body; a contact or circuit etched on, or embedded in, the electronic block connector body; a plurality of metal contact pins extending from the electronic block connector body; and a wire, wires or flex circuit electrically connected to the contact or circuit on the electronic block connector body.

As will be explained further herein, advantages of the present elastomeric member include the fact that the male connector system can be designed to be fastened very securely into the female connector interface in a medical device. In preferred embodiments, such connection is secure enough such that an audible "click" can be heard when the male connector is received into the female connector interface. The present system can thus be engineered to provide a preferred tactile feel, and/or tactile "snap" together. Moreover, the elastomeric member may also act as a vibration damper, preventing rattling or wobbling of the male connector in the female connector interface.

As will be explained herein, further advantages of an O-ring elastomeric member on the distal end of the connector body include: providing environmental sealing (permitting wiping), and permitting electrical isolation at low-cost. Additionally, the use of an elastomeric O-ring would not scratch or damage the female receptacle, while assisting in co-axial line up of the male connector and female connector interface. This important in ensuring the proper alignment of the contacts. Further advantages of the present invention include being able to select a connector engineered to have a preferred tactile feel, retention strength and/or insertion strength for a particular application.

The present invention also provides a method of providing a male connector for use with a female connector interface on an industry standard medical device, including: determining the dimensions and electrical configuration of a female connector interface in an industry standard medical device; selecting a male connector body having a distal end dimensioned to be received into the female connector interface, wherein an elastomeric member is disposed on the distal end of the male connector body, and wherein a proximal end of the male connector body is dimensioned to receive an electronic block connector therein; selecting an electronic block connector configured for operation with the female connector interface in the medical device; and inserting the electronic block connector into the proximal end of the male connector body.

In an aspect of the preferred method, the male connector body and the electronic block connector are selected independently of one another prior to inserting the electronic block connector into or onto the proximal end of the male connector body. Most preferably, the male connector body is selected from a family of different male connector bodies, each configured to be received into a different female connector interface in an industry standard medical device, and the electronic block connector is selected from a family of different electronic block connectors, each configured to be connected to a different industry standard medical device.

As will be explained further herein, advantages of the present method include the fact that a small number of male connector bodies and a small number of electronic block connectors can be assembled in a very large number of combinations such that a wide variety of medical device components can be connected together. For example, using a small number of male connector bodies and a small number of electronic block connectors, the present system and method can be used to easily connect various equipment (e.g.: surgical devices, treatment devices, diagnostic devices, etc.) to various standard power generators.

Thus, the present invention represents a fundamental change from existing connector systems in which a uniquely designed (i.e. proprietary) connector is provided for each medical device connector application.

DETAILED DESCRIPTION OF THE DRAWINGS

Figure 1:
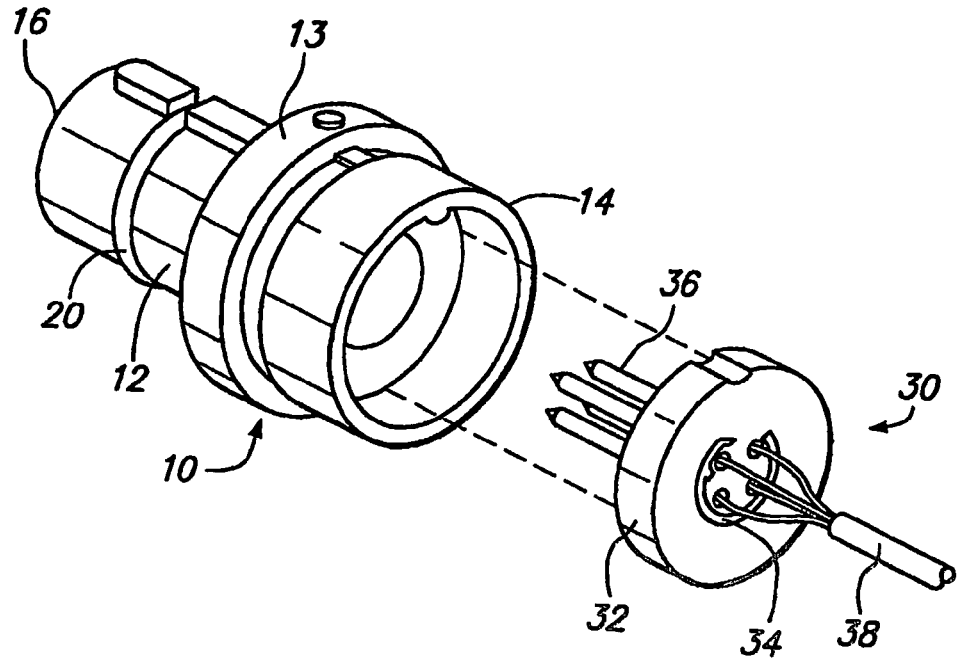
FIG. 1 is a rear exploded perspective view of an embodiment of the invention.
Figure 2:
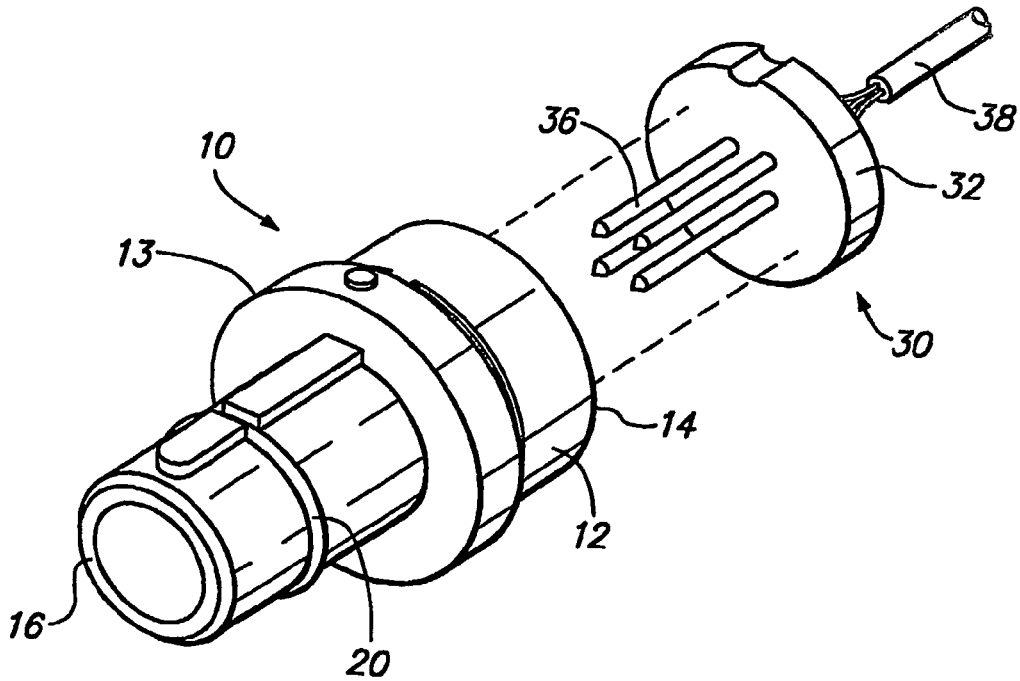
FIG. 2 is a front exploded perspective view of an embodiment of the invention.

FIGS. 1 and 2 provide rear and front exploded perspective views of the present male connector system. Specifically, male connector 10 has a body 12 with a proximal end 14 and a distal end 16. An elastomeric member 20 is disposed around an outer surface of distal end 16 of body 12. Distal end 16 of body 12 is configured to be received into a female connector interface in a medical device (shown in FIG. 4). Proximal end 14 of body 12 is configured to receive an electronic block connector 30 therein (as also shown in more detail in FIG. 4). In optional embodiments, elastomeric member 20 may instead comprise a spring, such as a canted coil spring, or other spring structures.

Figure 4:
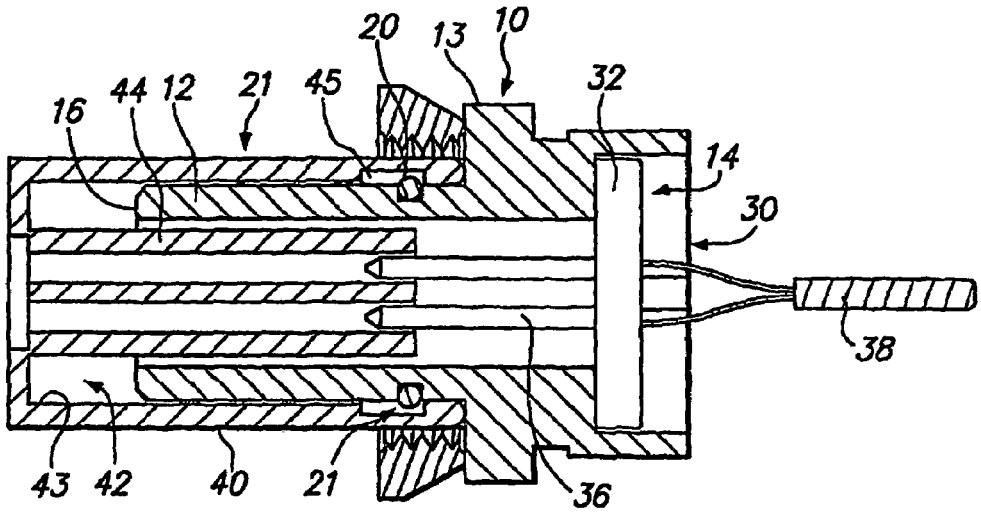
FIG. 4 is a sectional side elevation view of an embodiment of the present invention with the electronic block connector received into the male connector body and the male connector body received into an industry standard female connector interface.

Connector body 12 may be tubular and may be hollow, as shown. However, the present invention is not so limited. For example, connector body 12 may also be rectangular, triangular, square, oval or any other shape, with its shape being chosen so as to fit into an associated female connector interface on an industry standard medical device. An optional collar 13 may extend from body 12 and is dimensioned to limit the depth to which male connector 12 is received into an industry standard female connector (as shown in FIG. 4).

Elastomeric member 20 may be an O-ring fully surrounding the outer surface of distal end 16 of body 12. Such an O-ring or elastomeric member can be made to many different shapes, sizes and cross sections, depending upon the particular connector application. In alternate embodiments, elastomeric member 20 may only partially surround the distal end 16 of body 12, still keeping within the scope of the present invention. In various embodiments, elastomeric member 20 may be made of various materials (having different durometers).

Electronic block connector 30 preferably includes an electronic block connector body 32 with an electronic contact 34 etched thereon (or circuit embedded therein). A plurality of metal contact pins 36 extend from electronic block connector body 32. An electrical wire or wires 38 (or optionally a flex circuit) is electrically connected to contact 34 on or in body 32. An example of a suitable electronic block connector 30 can be found in U.S. Patent Published Application 2003/0233087, the complete disclosure of which is incorporated herein by reference in its entirety for all purposes. It is to be understood, however, that the present invention is not so limited, and that any electronic block connector (or other interconnection) design can be incorporated into the present invention.

In accordance with a preferred method of the present invention, a family of male connector bodies and a family of electronic block connectors are initially fabricated. Thereafter, a particular medical device male connector is assembled by matching and interconnecting one of the family of male connector bodies with one of the family of electronic block connectors. Thus, the present method provides a system in which a suitable male connector can be quickly fabricated, produced or otherwise provided by assembling one of a family of male connector bodies with one of a family of electronic block connectors.

Figure 3:
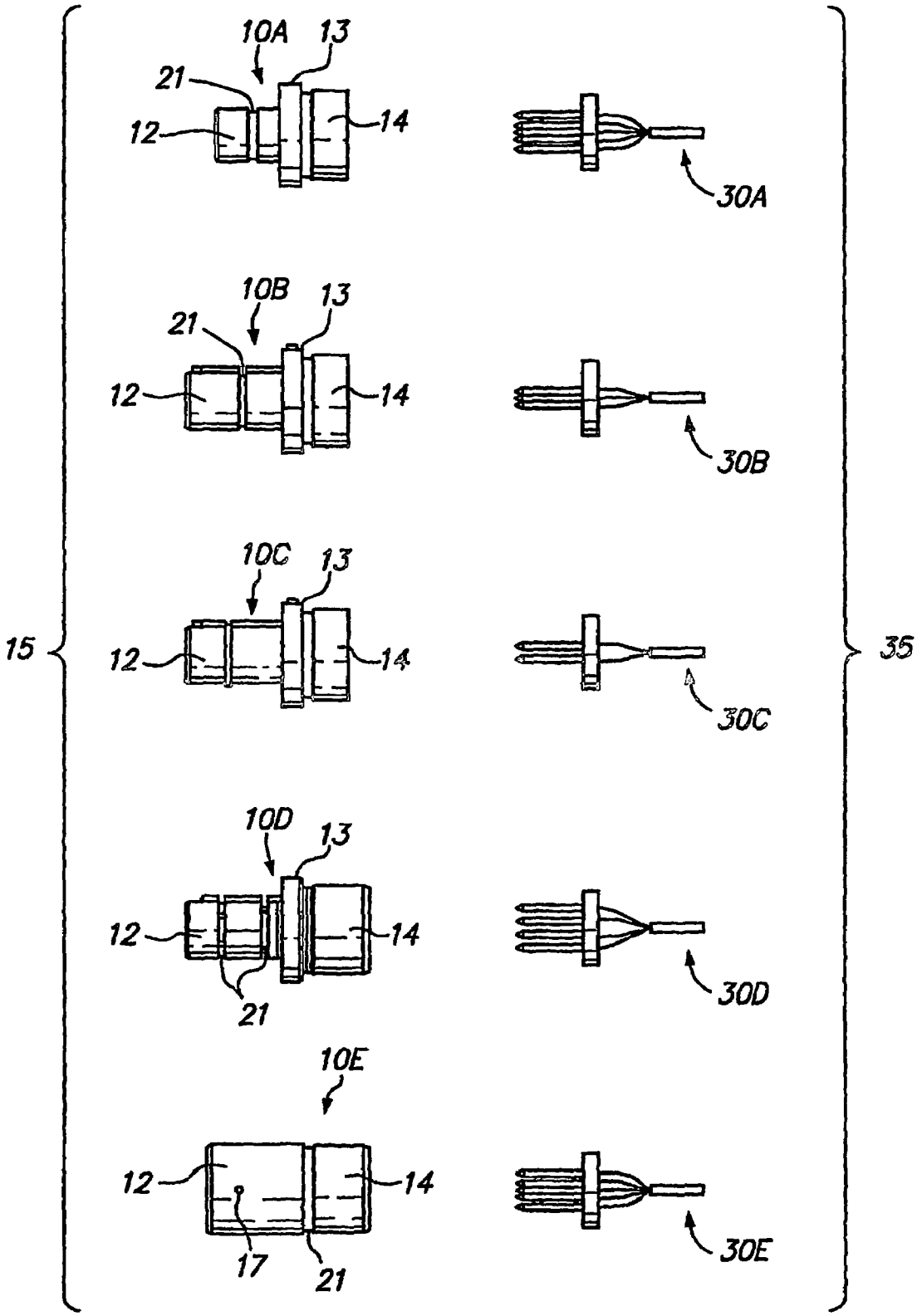
FIG. 3 is a side elevation view of a family of male connectors adjacent to a family of electrical block connectors.

Referring to FIG. 3, a family 15 of male connector bodies 10A to 10E is provided. Each member of family 15 is preferably manufactured so as to be dimensioned to be received into a different industry standard female connector interface on a medical device (as shown in FIG. 4). A family 35 of electronic block connectors 30A to 30E is also provided.

As can be seen, the distal ends 16 of the various male connector bodies 10A to 10D may be sized considerably different from one another, so as to fit into different sized female connector interfaces. Moreover, as shown by male connector body 10D, a plurality of elastomeric members 20 may optionally be used on distal end 16 of a single male connector body. (For ease of illustration, elastomeric members 20 are not shown in FIG. 3. It is to be understood that elastomeric members 20 are received into grooves 21 in connector bodies 12.)

In various embodiments, each of collars 13 has the same diameter. For example, collars 13 on connector bodies 12 in connectors 10A to 10D may have the same diameter. The present invention is not so limited. For example, collar 13 on connector body 12 of connector 10E has a different diameter. In addition, an outer surface of connector body 12 may have a series of optional bumps 17 protruding radially outwards therefrom (as seen on connector 10E). For example, two bumps 17 may be provided, each being on opposite sides of connector body 12. In alternate embodiments, a greater number of bumps 17 may be provided around connector body 12. Bumps 17 function so as to provide a engineered amount of interference, resistance, and alignment when distal end 16 of connector 10E is received into an appropriately dimensioned female interface. In various embodiments, bumps 17 may be spaced circumferentially around, or along the length of connector body 12, as desired.

The proximal ends 14 of the various male connector bodies 10A to 10E are preferably dimensioned the same size as one another, such that any one of the electronic block connectors 30A to 30E may be received into any of the various male connector bodies 10A to 10E. Electronic block connectors 30A to 30E may preferably be configured differently from one another. For example, they may have different electronic contacts 34 thereon, and have different numbers of metal contact pins 36 extending therefrom. Preferably, however, the plurality of metal contact pins 36 extending from the electronic block connector body 32 are arranged in an industry standard pattern for insertion into respective contact holes in an industry standard female connector interface in a medical device.

FIG. 4 illustrates electronic block connector 30 received into the male connector body 12 with male connector body 12 in turn received into an industry standard female connector interface 40. As can be seen, female connector interface 40 may include a recess 42 and a insulator 44. Elastomeric member 20 (which is received into groove 21) on distal end 16 of connector body 12.

As can be seen, elastomeric member 20 is received against the inner wall 43 of recess 42. Elastomeric member 20 thus forms an environmental seal that prevents moisture from entering into recess 42 and contacting insulator 44. This also increases the electrical performance of the connection system. Most preferably, the dimensions and materials of elastomeric member 20 are selected so as to provide a desired tactile feel and audible "click" when inserting or removing connector 10 from female connector interface 40. For example, the dimensions and materials of elastomeric member 20 are selected so as to have a desired coefficient of friction such that the present invention achieves a preferred engineered friction fit.

As can also be seen, elastomeric member 20 may expand such that it snaps into recess 45 when male connector body 12 is fully received into an industry standard (or custom) female connector interface 40. When O-ring 20 enters recess 45, O-ring 20 expands such that friction between male connector body 12 and inner wall 43, such that distal end 16 snaps completely into recess 42. Such snapping may generate an audible clicking sound to alert the user to the fact that the male connector body 12 is fully received into the industry standard or custom female connector interface 40.

Figure 5:
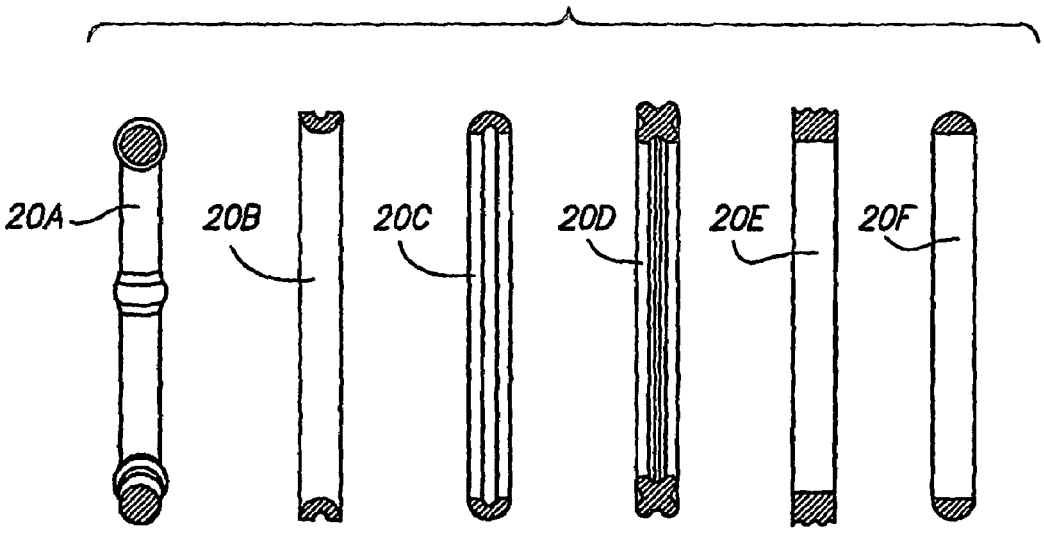
FIG. 5 shows sectional views through various embodiments of the elastomeric O-ring member.
Figure 6A:
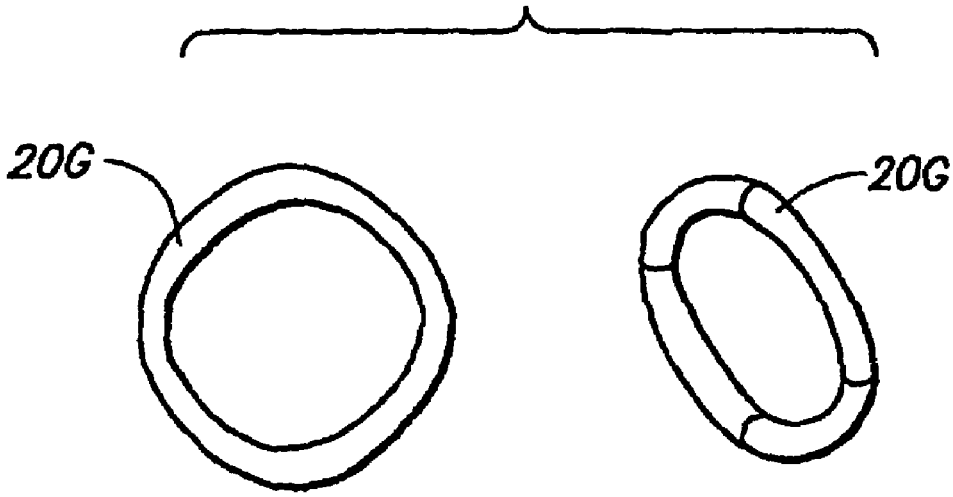
FIGS. 6A and 6B show front views of various further embodiments of the elastomeric O-ring member.
Figure 6B:
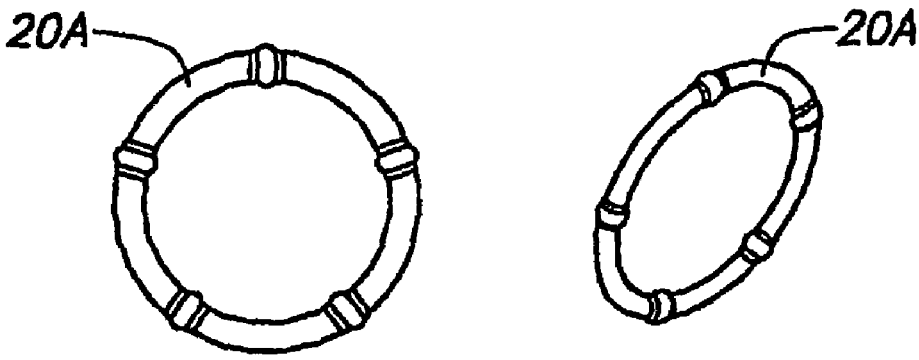

As stated above, elastomeric member may have a constant cross sectional area (as shown in elastomeric members 20B to 20F in FIG. 5) or a variable cross sectional area. (as shown in elastomeric member 20A and 20G in FIGS. 5, 6A and 6B). For example, a variety of different elastomeric members 20A to 20G may be used in accordance with the present invention. It is to be understood that the embodiments of the elastomeric members shown as 20A to 20G are only exemplary. Numerous other designs are contemplated, all keeping within the scope of the present invention. FIGS. 6A and 6B show plan and perspective views, respectively of elastomeric member 20G and 20A. For clarity of illustration, elastomeric members 20A is shown both in FIG. 5 and in FIG. 6B. The embodiments of elastomeric members 20A and 20G both have non-uniform cross sections around their circumference. Stated another way, elastomeric member 20A and 20G have both thick portions and thin portions. Such non-uniform cross sectional designs are particularly advantageous, as follows. Different portions of the elastomeric members 20A and 20G protrude to different distances in the radial direction around the circumference of connector body 12. This feature can be especially advantageous when portions of the elastomeric member 20 are to be received into pockets or cut-away sections (e.g. recesses 45 in FIG. 4) of the female interface.

In other optional embodiments of the present invention, elastomeric O-ring member 20 (or bumps 17) may be overmolded or insert molded directly onto body 12. An advantage of such overmolding or insert molding is that the elastomeric member may be bonded directly to the outer (or inner) surface of connector body 12.

In accordance with the present invention, female connector interface 40 may be an output on an industry standard medical device generator. However, the present invention is not so limited. For example, female connector interface 40 may be a connection terminal on any medical device.

FIGS. 7A to 7D show an embodiment of the invention in which two elastomeric O-ring members are used on a single male connector body 12, as follows. O-ring members 20A and 20B are placed into grooves 21A and 21B, respectively. (For clarity of illustration, O-ring members 20A and 20B are shown as removed from grooves 21A and 21B, respectively, such that the surface details of grooves 21A and 21B can be seen).

Figure 7A:
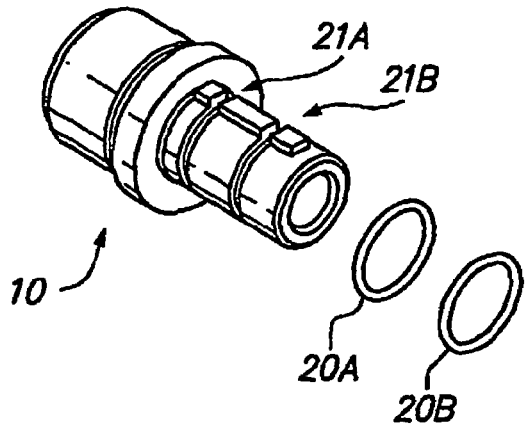
FIG. 7A is a perspective view of a dual O-ring embodiment of the present invention, wherein the O-rings are received into grooves that are dimensioned differently from one another.
Figure 7B:
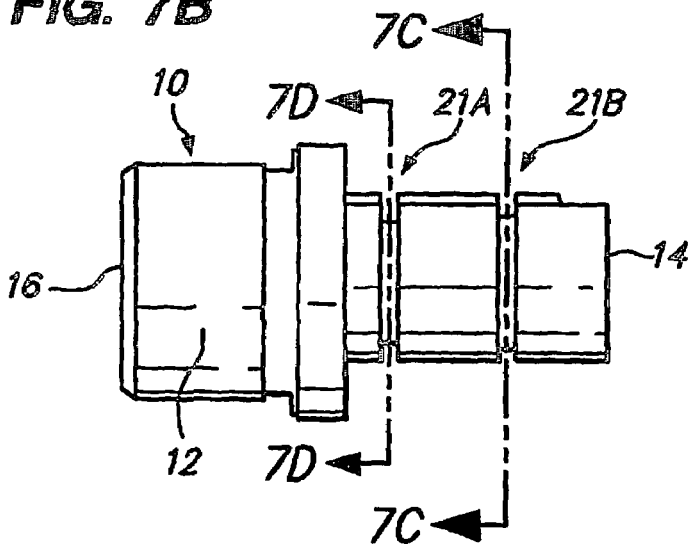
FIG. 7B is a side elevation view corresponding to FIG. 7A.
Figure 7C:
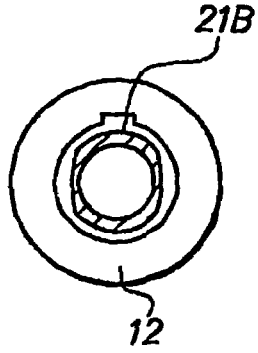
FIG. 7C is a sectional view along line 7C-7C in FIG. 7B.
Figure 7D:
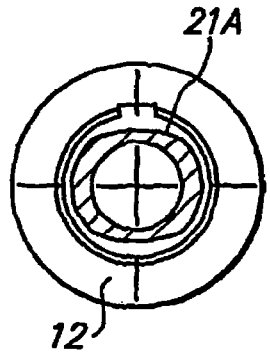
FIG. 7D is a sectional view along line 7D-7D in FIG. 7B.

FIG. 7B shows a side elevation view of connector body 12. As can be seen, groove 21A is dimensioned differently from groove 21B. Specifically, as seen in FIG. 7C, groove 21B is dimensioned deeper along the sides of connector body 12, and shallower along the top and bottom of connector body 12. Conversely, as seen in FIG. 7D, groove 21A is dimensioned shallower along the sides of connector body 12, and deeper along the top and bottom of connector body 12. The design shown in FIGS. 7A to 7D can be especially useful in that different portions of O-rings 20A and 20B can protrude radially outwardly to different dimensions. Such radially outwardly extending portions may optionally be received into recesses 45 within a female connector interface 40 (shown in FIG. 4). A further advantage of having O-ring 20A protrude farther outwardly from the sides of connector body 12, and O-ring 20B protrude farther outwardly from the top and bottom of connector body 12 is that O-ring 20A will give the connection (i.e. of connector body 12 into female connector interface 40) greater stability in the horizontal direction. Similarly, O-ring 20B will give the connection greater stability in the vertical direction.

Figure 8A:
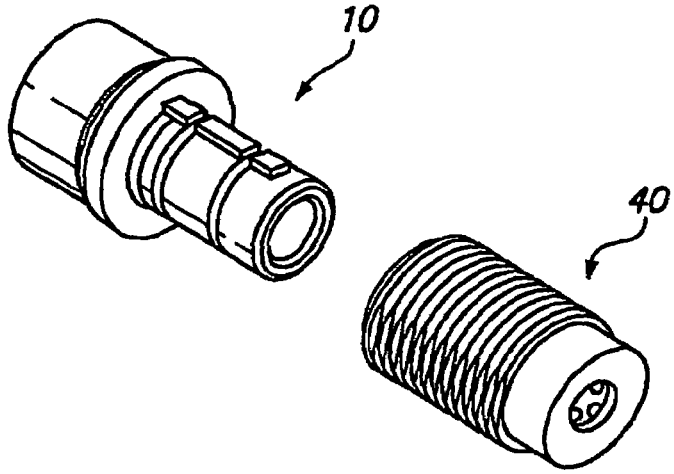
FIG. 8A is a perspective view of a male connector positioned to be received into a female connector interface.
Figure 8B:
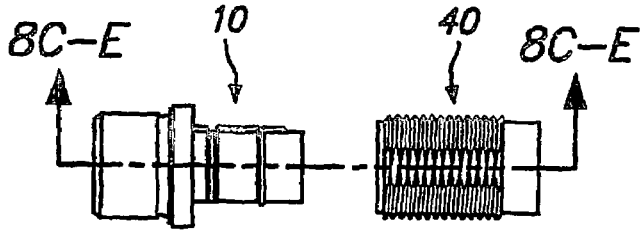
FIG. 8B is a side elevation view corresponding to FIG. 8A.
Figure 8C:
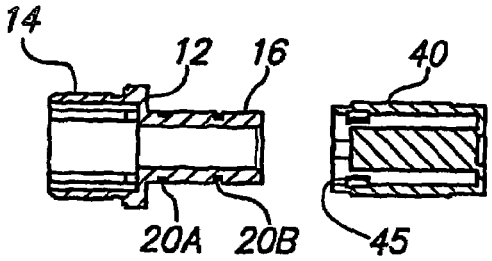
FIGS. 8C to 8E show sequential sectional views of the male connector being received into the female connector interface as taken along line 8-8 in FIG. 8B.
Figure 8D:
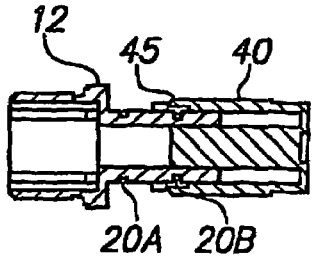
Figure 8E:
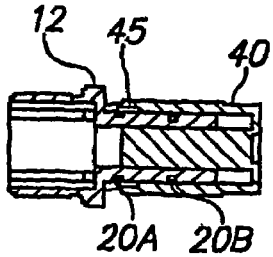

FIGS. 8A and 8B show male connector body 12 positioned to be received into female connector interface 40. FIGS. 8C to 8E show sequential insertion of male connector body 12 into female connector interface 40. At the stage shown in FIG. 8D, elastomeric member 20B passes recess 45 in the interior of female connector interface 40. At the final stage shown in FIG. 8E, second elastomeric member 20A expands firmly in position in recess 45, thereby securing male connector body 12 and female connector interface 40 together.

Figure 9:
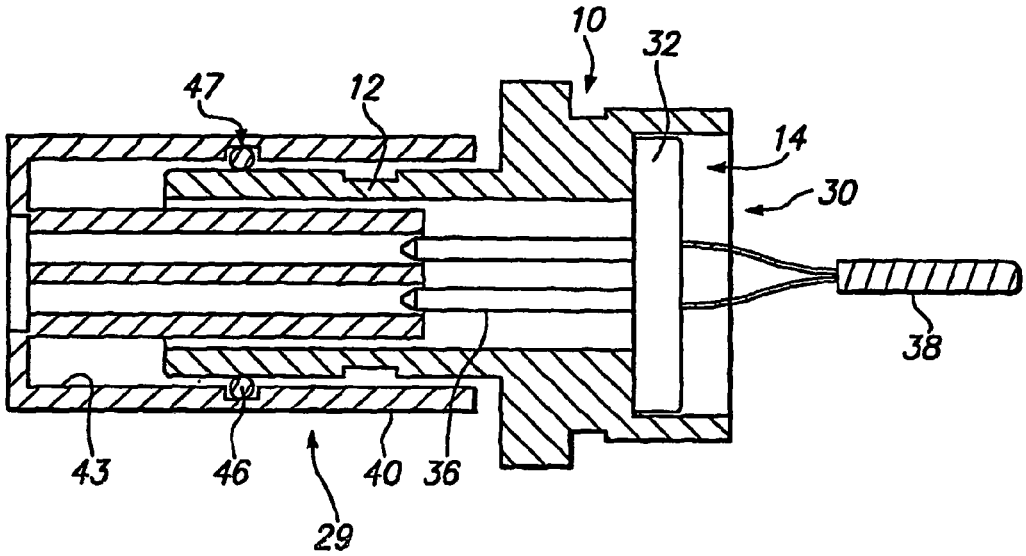
FIG. 9 is a side elevation view of an embodiment of the invention in which the elastomeric member is instead disposed in the female connector interface.

In accordance with another preferred embodiment of the present invention, the elastomeric member can be provided on the female connector interface. For example, referring to FIG. 9, female connector interface 40 may have an O-ring 46 received in groove 47 on inner wall 43. Male connector body 12 has a recess 29 therein. When male connector body 12 is fully received into female connector interface 40, O-ring 46 in female connector interface 40 is received into recess 29, thus holding male connector body 12 and female connector interface 40 together.

Figure 10A:
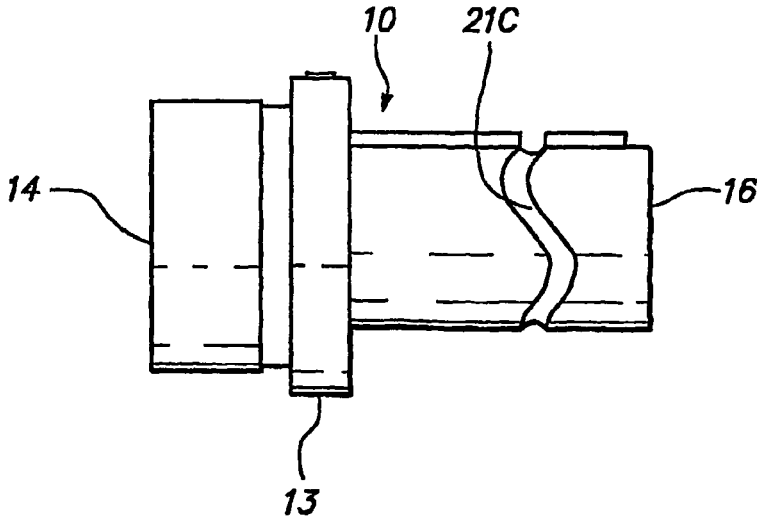
FIGS. 10A, 10B and 10C show male connector bodies with variable O-ring groove shapes.
Figure 10B:
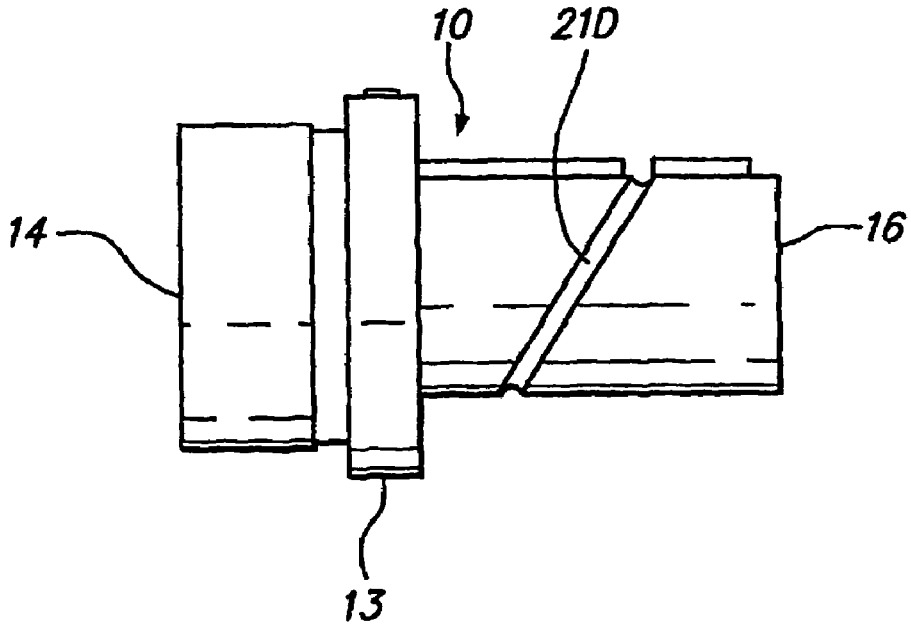
Figure 10C:
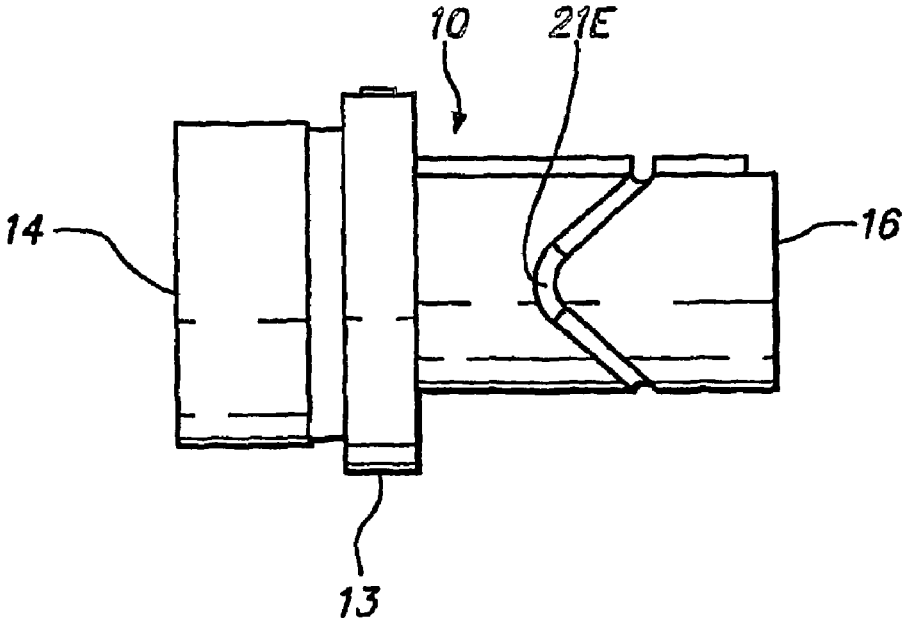

FIGS. 10A, 10B and 10C show male connector bodies with variable O-ring groove shapes, as follows. In FIG. 10A, male connector 10 has a wavy-shaped groove 21C. In FIG. 10D, male connector 10 has a straight groove 21D which is angled to the longitudinal axis of the connector. In FIG. 10C, male connector 10 has a groove 21E.

The present invention also includes a preferred method of providing a male connector for use with a female connector interface on an industry standard medical device. It is to be understood that, as used herein, "providing a male connector" includes, but is not limited to "fabricating a male connector", "selecting a male connector", "designing a male connector", "configuring a male connector", etc. Most preferably, the preferred method includes: determining the dimensions and electrical configuration of a female connector interface 40 in an industry standard (or custom) medical device; selecting a male connector body 12 having a distal end 16 dimensioned to be received into female connector interface 40, wherein an elastomeric member 20 is disposed on the distal end 16 of male connector body 12, and wherein a proximal end 14 of male connector body 12 is dimensioned to receive an electronic block connector 30 therein; selecting an electronic block connector 30 configured for operation with female connector interface 40 in the medical device; and inserting the electronic block connector 30 into the proximal end 14 of male connector body 12.

As illustrated above in FIG. 3, a particular male connector body 12 and electronic block connector 30 are selected independently of one another prior to inserting electronic block connector 30 into proximal end 14 of male connector body 12. In other words, a particular male connector 10A to 10E is selected from family 15, and a particular electronic block connector 30A to 30E is selected from family 35. Each member of family 15 is configured to be received into a different female connector interface 40, and each member of family 35 is configured to be connected to a different industry standard (or custom) medical device.

An advantage of the present method is that the members of families 15 and 35 may both be fabricated prior to determining the dimensions and electrical configuration of a particular female connector interface 40 in an industry standard (or custom) medical device. For example, the present inventors have experimentally determined that seven differently designed connector bodies 12 and fifty-one differently configured electronic block connectors 30 can interconnect with one hundred and forty industry standard female medical device connectors from four different manufacturers. It is to be understood, however, that many more combinations are possible.

A further advantage of the present method is that the particular properties (e.g.: the dimensions, the coefficient of friction, etc.) of elastomeric member 20 may be selected when elastomeric member 20 is first placed onto distal end 16 of connector body 12. As such, the present invention encompasses engineering, fabricating and/or selecting an elastomeric member 20 with a preferred tactile feel. Engineering, fabricating and/or selecting an elastomeric member 20 with a preferred tactile feel may include engineering, fabricating and/or selecting a preferred insertion strength or retention strength for connector 10 in female connector interface 40.

What is claimed is:

1. A male connector, comprising:

a body having a proximal end and a distal end; and an elastomeric member disposed around an outer surface of the distal end of the body, wherein the distal end of the body is configured to be received into a female connector interface in a device, and wherein the proximal end of the body is configured to couple with an electronic block connector selected from a plurality of electronic block connectors, each of which has a different pin arrangement but a common coupling interface;

wherein the elastomeric member is an O-ring with a variable cross section.

2. A male connector, comprising:

a body having a proximal end and a distal end; and an elastomeric member disposed around an outer surface of the distal end of the body, wherein the distal end of the body is configured to be received into a female connector interface in a device, and wherein the proximal end of the body is configured to couple with an electronic block connector selected from a plurality of electronic block connectors, each of which has a different pin arrangement but a common coupling interface;

wherein the elastomeric member is received into a groove on the outer surface of the distal end of the body; and wherein the groove has a variable cross section.

3. A male connector, comprising:

a body having a proximal end and a distal end; and an elastomeric member disposed around an outer surface of the distal end of the body, wherein the distal end of the body is configured to be received into a female connector interface in a device, and wherein the proximal end of the body is configured to couple with an electronic block connector selected from a plurality of electronic block connectors, each of which has a different pin arrangement but a common coupling interface;

wherein the elastomeric member is received into a groove on the outer surface of the distal end of the body; and wherein the groove is not perpendicular to a longitudinal axis extending through the male connector.

* * * * *